United States Patent [19]

Hägel et al.

[11] 4,154,068

[45] May 15, 1979

[54] NEEDLE BAR FOR WARP KNITTING MACHINES

[75] Inventors: Adolf Hägel, Bobengrun; Manfred Thümling, Schwarzenbach, both of Fed. Rep. of Germany

[73] Assignee: Liba Maschinenfabrik GmbH, Fed. Rep. of Germany

[21] Appl. No.: 848,445

[22] Filed: Nov. 4, 1977

[30] Foreign Application Priority Data

Dec. 7, 1976 [DE] Fed. Rep. of Germany ..... 2655269

[51] Int. Cl.[2] ..... D04B 35/04; D04B 35/06; D04B 35/02

[52] U.S. Cl. ..... 66/121; 66/123

[58] Field of Search ..... 66/114, 122, 123, 121, 66/87, 88, 208

[56] References Cited

U.S. PATENT DOCUMENTS

| | | | |
|---|---|---|---|
| 1,496,341 | 6/1934 | Kochenderfer | 66/214 |
| 3,811,298 | 5/1974 | Kohl | 66/208 |
| 3,823,581 | 7/1974 | Russo | 66/208 |
| 3,978,691 | 9/1976 | Schmid | 66/208 |

FOREIGN PATENT DOCUMENTS

| | | | |
|---|---|---|---|
| 2126522 | 4/1972 | Fed. Rep. of Germany | 66/208 |

*Primary Examiner*—Ronald Feldbaum
*Attorney, Agent, or Firm*—Jacobs & Jacobs

[57] ABSTRACT

Needle bar for warp knitting machines with a number of needles individually set into slits of the bar and having shafts cranked to such an extent that the head section of each needle is in alignment with the shaft section accommodated by the slit. Slackening of the needles will thus not influence the needle spacing.

2 Claims, 4 Drawing Figures

NEEDLE BAR FOR WARP KNITTING MACHINES

The present invention relates to a needle bar for warp knitting machines with needles individually set, by means of a needle shaft section bent relatively to the head section of the needle shaft, into slits of the bar and held there.

Known needle bars of this type have simply bent needle shafts. To place the bent shaft section of the needle into the milled slit of the needle bar by hand, it is necessary to provide a certain amount of play. This small play causes spacing faults in the region of the needle heads of the bent needles because the needle head may swing around the longitudinal axis of the bent needle shaft section due to the distance between head and axis. If an exact spacing in the needle head region is desired though the needles are set individually, the needle shaft thickness and the slit width of the needle bar would have to be produced with a very high degree of manufacturing accuracy which is practically impossible in quantity production.

It is, therefore, an object of the invention to avoid these disadvantages and to permit the use of bent needles individually set without requiring high standards of accuracy. A needle bar according to the invention comprises needles with shaft sections cranked to such an extent that the head section of the needle is in alignment with the longitudinal axis of the needle shaft accomodated by a slit in the needle bar.

Because the needle head lies in the longitudinal axis of the shaft section held in the respective slit, the play in the slit will not produce a swinging motion of the needle head an an alteration of spacing, but only a trifling turn of the needle head around its axis which has no influence on the machine performance.

It may be of special advantage to design the needles in such a manner that the hook is in alignment with the longitudinal center axis of the cranked shaft.

Figure 1:
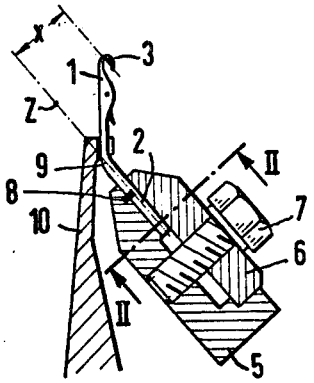
FIG. 1 PRIOR ART
Figure 2:
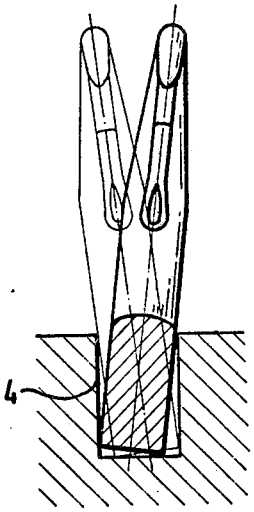
FIG. 2 PRIOR ART
Figure 3:
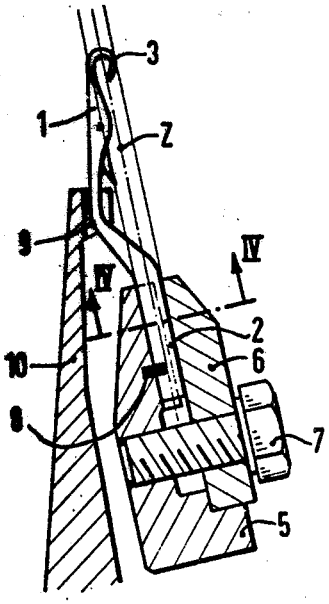
Figure 4:
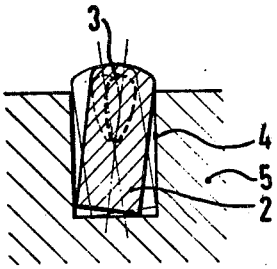

Further features and advantages of the invention will readily become apparent from the following description of an embodiment shown schematically in the accompanying drawing in which FIG. 1 shows a section of a needle bar known in the art, FIG. 2 is a cross section taken along the line II—II of FIG. 1, in an enlarged scale, FIG. 3 shows a needle bar according to the invention, and FIG. 4 is a cross section, in an enlarged scale, taken along the line IV—IV of FIG. 3.

As shown in FIG. 1, a known needle bar 5 bears needles 1 having a single bend. The shaft 2 is set into a slit 4 and held there by a clamping plate 6 fastened by clamping screws 7 and fixed by slot and feather 8. The needle cooperates with a trick plate 10 and thread guides, not shown, in a well known way. The hook 3 of the head portion has a distance x from the longitudinal axis Z of the shaft section. Therefore, if the shaft section turns within the slit 4, the needle head will swing around the axis Z causing a considerable spacing fault as indicated in FIG. 2.

An embodiment of the invention is shown in FIG. 3 comprising reference numerals corresponding to those in FIG. 1. However, the latch needle 1 of a Raschel machine is cranked at 9 in such a way that the head portion 3 lies within the range of alignment with the longitudinal center axis Z of the needle shaft section 2.

The shaft section 2 is shown in FIG. 4 with a rectangular cross section and accomodated by a correspondingly designed slit 4 of the needle bar 5. As in FIG. 1, the shaft section 2 is held by a clamping plate 6 with clamping screws 7 and fixed longitudinally by slot and feather 8.

If the needle shaft 2 tilts within the slit 4 of bar 5 because of the play, as shown in FIG. 4, the spacing inaccuracy of needle head 3 will not increase because the latter is aligned with the longitudinal axis of the needle shaft section 2.

Needles designed according to FIG. 3 may, therefore, be readily removed from slit 4, after loosening of the clamping plate 6, and reset into place without influencing the needle spacing in the range of the needle head 3.

While a specific embodiment has been shown and described in detail, it will be apparent that the invention may be applied to other types of needles and needle bars.

What is claimed is:

1. A needle bed assembly for a warp knitting machine, comprising a needle support having a plurality of slits therein for individually holding a needle and a plurality of needles mounted in said needle support, each said needle being having a head portion at one end and a shaft portion at the other end and cranked portion between said ends, the shaft portion of each needle being individually secured in its respective slit, and the longitudinal axis of said head portion of each needle being coaxial with the longitudinal axis of said shaft portion.

2. Needle bed as claimed in claim 1, having a hook aligned with the longitudinal axis of said shaft portion.

* * * * *